US012709868B2

(12) United States Patent
Kozui

(10) Patent No.: US 12,709,868 B2
(45) Date of Patent: Aug. 18, 2026

(54) DRIVE CONTROL DEVICE FOR CONSTRUCTION MACHINE AND CONSTRUCTION MACHINE PROVIDED WITH SAME

(71) Applicant: KOBELCO CONSTRUCTION MACHINERY CO., LTD., Hiroshima (JP)

(72) Inventor: Masatoshi Kozui, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 73 days.

(21) Appl. No.: 18/730,484

(22) PCT Filed: Jan. 19, 2023

(86) PCT No.: PCT/JP2023/001565

§ 371 (c)(1),
(2) Date: Jul. 19, 2024

(87) PCT Pub. No.: WO2023/145609

PCT Pub. Date: Aug. 3, 2023

(65) Prior Publication Data

US 2025/0129570 A1 Apr. 24, 2025

(30) Foreign Application Priority Data

Jan. 28, 2022 (JP) ..... 2022-011751

(51) Int. Cl.
*E02F 9/20* (2006.01)
*E02F 3/43* (2006.01)
*E02F 9/26* (2006.01)

(52) U.S. Cl.
CPC ..... *E02F 9/2029* (2013.01); *E02F 3/43* (2013.01); *E02F 9/265* (2013.01)

(58) Field of Classification Search
CPC . E02F 9/2029; E02F 3/43; E02F 9/265; E02F 3/437
(Continued)

(56) References Cited

U.S. PATENT DOCUMENTS

2020/0325650 A1* 10/2020 Tsukamoto ..... E02F 9/205
2021/0332561 A1 10/2021 Kozui et al.
(Continued)

FOREIGN PATENT DOCUMENTS

EP 3 733 978 A1 11/2020
JP 2020-33814 A 3/2020
(Continued)

OTHER PUBLICATIONS

Extended European Search Report issued Mar. 12, 2025 in European Patent Application No. 23746822.8, 7 pages.
(Continued)

*Primary Examiner* — Maceeh Anwari
(74) *Attorney, Agent, or Firm* — Oblon, McClelland, Maier & Neustadt, L.L.P.

(57) ABSTRACT

A drive control device for a construction machine includes a controller that controls the movement of a work device. The controller sets a target land leveling angle, which is a target for a land leveling angle in land leveling work performed by the work device, calculates a pivoting member gravity center velocity, which is the velocity of the center of gravity of a pivoting member, calculates a target velocity, which is a target for a velocity of the composite center of gravity of the entire work device by using the pivoting member gravity center velocity and the target land leveling angle, and controls the movement of a boom to make the actual velocity of the composite center of gravity closer to the target velocity.

8 Claims, 15 Drawing Sheets

(58) Field of Classification Search
USPC ..... 701/50
See application file for complete search history.

(56) References Cited

U.S. PATENT DOCUMENTS

| | | | |
|---|---|---|---|
| 2021/0340736 | A1 | 11/2021 | Kozui et al. |
| 2022/0364337 | A1 | 11/2022 | Shimizu et al. |

FOREIGN PATENT DOCUMENTS

| | | | |
|---|---|---|---|
| JP | 2020-33815 | A | 3/2020 |
| JP | 2021-55289 | A | 4/2021 |
| JP | 2021-59855 | A | 4/2021 |

OTHER PUBLICATIONS

International Search Report issued Mar. 20, 2023 in PCT/JP2023/001565 filed Jan. 19, 2023, 2 pages.

* cited by examiner

DRIVE CONTROL DEVICE FOR CONSTRUCTION MACHINE AND CONSTRUCTION MACHINE PROVIDED WITH SAME

TECHNICAL FIELD

The present disclosure relates to a drive control device for a construction machine and a construction machine provided with the same.

BACKGROUND ART

Conventionally, as a construction machine, a hydraulic excavator including a body and a work device supported by the body to allow a derricking movement is known. The work device of the hydraulic excavator includes a boom, which is supported by the body to allow a derricking movement, and a pivoting member, which is pivotably supported by the boom. The pivoting member includes an arm and a tip member, such as a bucket, which is pivotably supported by the arm. The boom, the arm, and the tip member are each moved by extendable hydraulic cylinders. Such a hydraulic excavator can perform various types of work such as excavation work.

Patent Literature 1 discloses a construction machine that can improve work efficiency in work such as excavation. The control device for the construction machine measures or calculates the motion state amount of the composite center of gravity of a plurality of members that constitutes the work device, determines an instruction value for the operating mechanism of the work device by using feedback control such that the motion state amount follows a predetermined first target value, and adjusts the amount of operation by the operator for the work device based on the instruction value.

Patent Literature 2 discloses a construction machine for mitigating the burden on the operator when repeatedly performing excavation work. Specifically, Patent Literature 2 describes that it is possible to linearly push a bucket simply by operating an arm in a pushing direction, and thus it becomes possible to mitigate the burden on the operator at time of excavation work.

Incidentally, in a construction machine such as a hydraulic excavator, land leveling work may be performed on the ground by using a tip member of the work device (for example, bucket). The land leveling work includes work such as leveling work, bottom smoothing work, and slope forming work. In the land leveling work, a target land leveling angle, which is a target for a land leveling angle, is set at various angles depending on the construction site, and the operator needs to cause the work device including a boom and a pivoting member to move such that the construction surface is leveled to the target land leveling angle. Although such land leveling work is not easy for an unskilled worker, Patent Literature 1 does not specifically mention how to control the movement of the work device depending on various target land leveling angles that are set in the land leveling work. Meanwhile, Patent Literature 2 is a technology for mitigating the burden on the operator during the excavation work, and does not consider the land leveling work at all.

CITATION LIST

Patent Literatures

Patent Literature 1: JP 2020-33815 A
Patent Literature 2: JP 2021-59855 A

SUMMARY OF INVENTION

An object of the present disclosure is to provide a drive control device that allows a work device to move in land leveling work such that a construction surface is leveled to a target land leveling angle and a construction machine provided with the same.

The present disclosure provides a drive control device for a construction machine including: a body; and a work device including a boom supported by the body to allow a derricking movement and a pivoting member pivotably supported by the boom, the drive control device including a controller that controls a movement of the work device, the controller: sets a target land leveling angle that is a target for a land leveling angle in land leveling work performed by the work device; calculates a pivoting member gravity center velocity that is a velocity of a center of gravity of the pivoting member; calculates a target velocity that is a target for a velocity of a composite center of gravity of the entire work device by using the pivoting member gravity center velocity and the target land leveling angle; and controls a movement of the boom to make an actual velocity of the composite center of gravity closer to the target velocity.

DESCRIPTION OF EMBODIMENTS

A preferred embodiment of the present disclosure will be described below with reference to the drawings.

Figure 1:
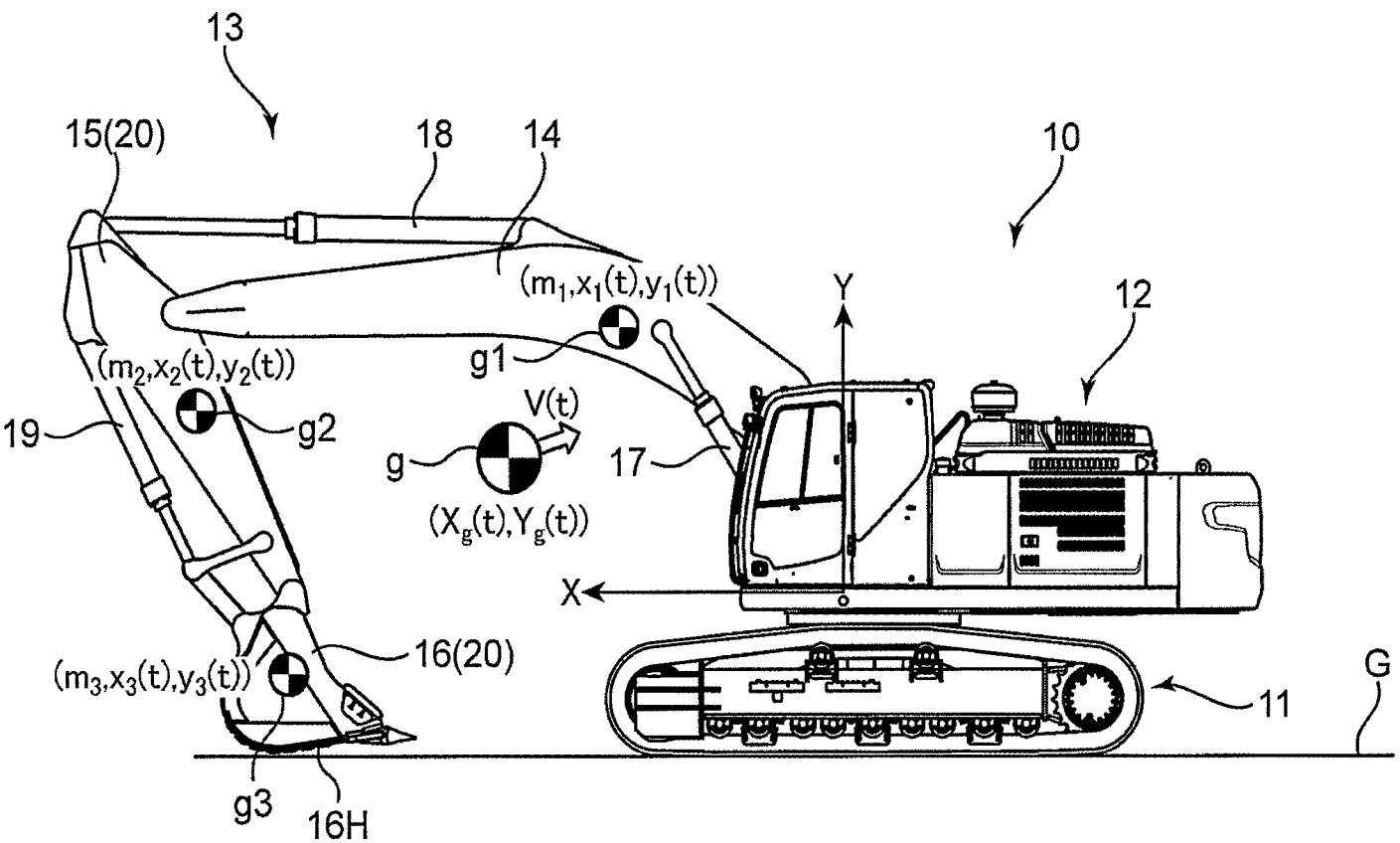
FIG. 1 is a side view showing a construction machine provided with a drive control device according to an embodiment of the present disclosure.

FIG. 1 is a side view showing a hydraulic excavator 10 on which a drive control device (FIG. 2) according to one embodiment of the present disclosure is mounted. The hydraulic excavator 10 is one example of a construction machine. The hydraulic excavator 10 includes a crawler-type lower travelling body 11 that can travel on the ground G, an upper slewing body 12 mounted on the lower travelling body 11 so as to be able to slew around the slewing center axis along the direction perpendicular to the ground, and a work device 13 mounted on the upper slewing body 12 to allow a derricking movement (work attachment 13). The work device 13 includes a boom 14 supported by the upper slewing body 12 to allow a derricking movement, and a pivoting member 20 pivotably supported by the boom 14. The pivoting member 20 includes an arm 15 pivotably connected to the tip of the boom 14, and a bucket 16 pivotably connected to the tip of the arm 15. The bucket 16 is one example of a tip member. The bucket 16 has a bucket bottom 16H. The upper slewing body 12 includes a slewing frame and a cab supported by the slewing frame. The lower travelling body 11 and the upper slewing body 12 are one example of a body.

The hydraulic excavator 10 includes a boom cylinder 17 that is actuated to cause the boom 14 to make a derricking movement with respect to the upper slewing body 12, an arm cylinder 18 that is actuated to cause the arm 15 to make a pivoting movement with respect to the boom 14, and a bucket cylinder 19 that is actuated to cause the bucket 16 to make a pivoting movement with respect to the arm 15. Each cylinder is actuated to expand and contract by receiving a hydraulic oil from a hydraulic pump.

Figure 2:
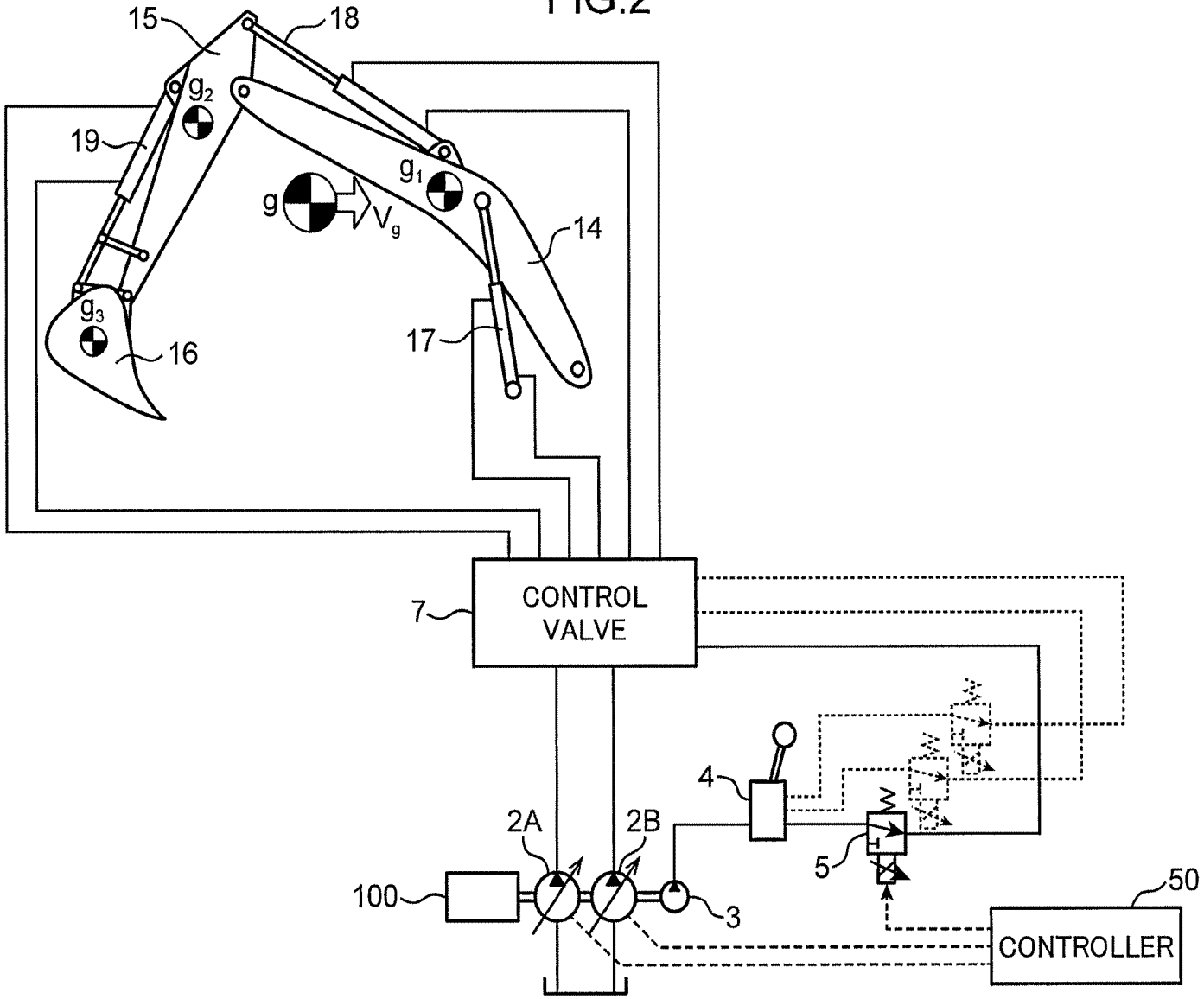
FIG. 2 is a hydraulic circuit diagram of the drive control device according to the embodiment.

FIG. 2 is a hydraulic circuit diagram of the drive control device according to the present embodiment. In FIG. 2, the same component as in the hydraulic excavator 10 shown in FIG. 1 is given the same reference symbol. In FIGS. 1 and 2, g1 indicates the center of gravity of the boom 14, g2 indicates the center of gravity of the arm 15, g3 indicates the center of gravity of the bucket 16, and g indicates the composite center of gravity of the work device 13.

The hydraulic excavator 10 further includes an engine 100, a hydraulic first pump 2A, a hydraulic second pump 2B, a hydraulic pump 3 for pilot pressure oil, an operation device 4, an electromagnetic proportional valve 5, a control valve 7, and a controller 50.

The engine 100 rotates upon receiving a predetermined amount of fuel injection. The first pump 2A and the second pump 2B are connected to an output shaft of the engine 100 and rotate upon receiving driving force of the engine 100. Each pump is a hydraulic pump and discharges the hydraulic oil for actuating the boom cylinder 17, the arm cylinder 18, and the bucket cylinder 19.

The boom cylinder 17 expands and contracts to cause the boom 14 to make a derricking movement (move) by receiving the supply of the hydraulic oil discharged from the first pump 2A. In the present embodiment, the boom cylinder 17 includes a cylinder body, and a cylinder rod that includes a piston portion that partitions the cylinder body into a head chamber and a rod chamber and is relatively movable with respect to the cylinder body. The tip of the cylinder rod is connected to the boom 14 via a link mechanism (not shown). The boom cylinder 17 can expand to cause the boom 14 to stand up (boom raising movement) by receiving the hydraulic oil discharged from the first pump 2A into the head chamber via the control valve 7 and discharging the hydraulic oil from the rod chamber. Meanwhile, the boom cylinder 17 can contract to cause the boom 14 to fall down (boom lowering movement) by receiving the hydraulic oil discharged from the first pump 2A into the rod chamber via the control valve 7 and discharging the hydraulic oil from the head chamber. Note that the arm cylinder 18 and the bucket cylinder 19 also have the similar structure to the boom cylinder 17.

The operation device 4 is operated by the operator and receives an operation to move the boom 14, the arm 15, and the bucket 16 of the work device 13. That is, the operation device 4 includes a boom operation device, an arm operation device, and a bucket operation device. The boom operation device receives a boom raising operation to cause the boom 14 to perform the boom raising movement and a boom lowering operation to cause the boom 14 to perform the boom lowering movement. The arm operation device receives an arm pulling operation to cause the arm 15 to perform an arm pulling movement and an arm pushing operation to cause the arm 15 to perform an arm pushing movement. The bucket operation device receives a bucket pulling operation to cause the bucket 16 to perform a bucket pulling movement and a bucket pushing operation to cause the bucket 16 to perform a bucket pushing movement. Note that the operation device 4 also receives operations related to the slewing movement of the upper slewing body 12 and the travelling movement of the lower travelling body 11, and the like. Note that all or a part of the operation device 4 is not limited to those provided in the hydraulic excavator 10, and may be disposed at a position different from the hydraulic excavator 10 in a case where the hydraulic excavator 10 is remotely controlled.

The control valve 7 is disposed to be interposed between the hydraulic pump and the boom cylinder 17, and includes a spool that moves to change (control) the flow rate and flow path of the hydraulic oil supplied from the hydraulic pump to the boom cylinder 17. Specifically, mainly when the boom 14 performs the boom raising movement and the boom lowering movement, the control valve 7 acts to supply the hydraulic oil of the hydraulic pump to the boom cylinder 17 and to discharge the hydraulic oil discharged from the boom cylinder 17 into a tank (not shown). The control valve 7 includes a pilot-operated three-position directional switching valve having one pair of pilot ports.

When the pilot pressure is input into none of the pair of pilot ports, the control valve 7 is maintained at the neutral position to shut off between the hydraulic pump and the boom cylinder 17.

When the boom lowering pilot pressure is input into one pilot port, the control valve 7 is switched from the neutral position to the boom lowering position with a stroke corresponding to the magnitude of the boom lowering pilot pressure. This causes the control valve 7 to be opened to allow the hydraulic oil to be supplied from the hydraulic pump to the rod chamber of the boom cylinder 17 at a flow rate corresponding to the stroke, and allow the hydraulic oil to be discharged from the head chamber of the boom cylinder 17. This causes the boom cylinder 17 to be driven in the boom lowering direction at a velocity corresponding to the boom lowering pilot pressure.

When the boom raising pilot pressure is input into the other pilot port, the control valve 7 is switched from the neutral position to the boom raising position with a stroke corresponding to the magnitude of the boom raising pilot pressure. This causes the control valve 7 to be opened to allow the hydraulic oil to be supplied from the hydraulic pump to the head chamber of the boom cylinder 17 at a flow rate corresponding to the stroke, and allow the hydraulic oil to be discharged from the rod chamber of the boom cylinder 17. This causes the boom cylinder 17 to be driven in the boom raising direction at a velocity corresponding to the boom raising pilot pressure.

Note that the control valve 7 that performs the same movement as described above is disposed between the hydraulic pump and each of the arm cylinder 18 and the bucket cylinder 19. The control valve 7 corresponding to the arm cylinder 18 can be switched to the arm pushing position, the neutral position, and the arm pulling position.

The electromagnetic proportional valve 5 is opened such that the pilot pressure (secondary pressure) corresponding to the operation input into the operation device 4 acts on each pilot port of the control valve 7 by the pilot oil supplied from the hydraulic pump 3 for pilot pressure oil. The opening degree of the electromagnetic proportional valve 5 is adjusted by a proportional signal input from the controller 50.

As shown in FIG. 2, the boom cylinder 17, the arm cylinder 18, and the bucket cylinder 19 expand and contract by receiving the supply of the hydraulic oil from at least one of the first pump 2A and the second pump 2B according to the operation amount that is the magnitude of the operation the operation device 4 receives. The boom cylinder 17, the arm cylinder 18, and the bucket cylinder 19 are supplied with the hydraulic oil from at least one of the first pump 2A and the second pump 2B through the control valve 7 that switches the direction of a supply oil. The operation device 4 may include an electric lever that can input an operation signal according to the operation amount to the controller 50, and may be configured such that a signal regarding the secondary pressure of the remote control valve of the operation device 4 is input to the controller 50. The controller 50 acquires the operation amount of operation given to the operation device 4 (boom operation device, arm operation device, and bucket operation device) as the boom operation value, the arm operation value, and the bucket operation value, and inputs an instruction signal to the electromagnetic proportional valve 5 corresponding to the operation according to each acquired operation value. The boom 14, the arm 15, and the bucket 16 of the work device 13 each move at a velocity according to the instruction signal (proportional signal) input to the electromagnetic proportional valve 5.

Figure 3:
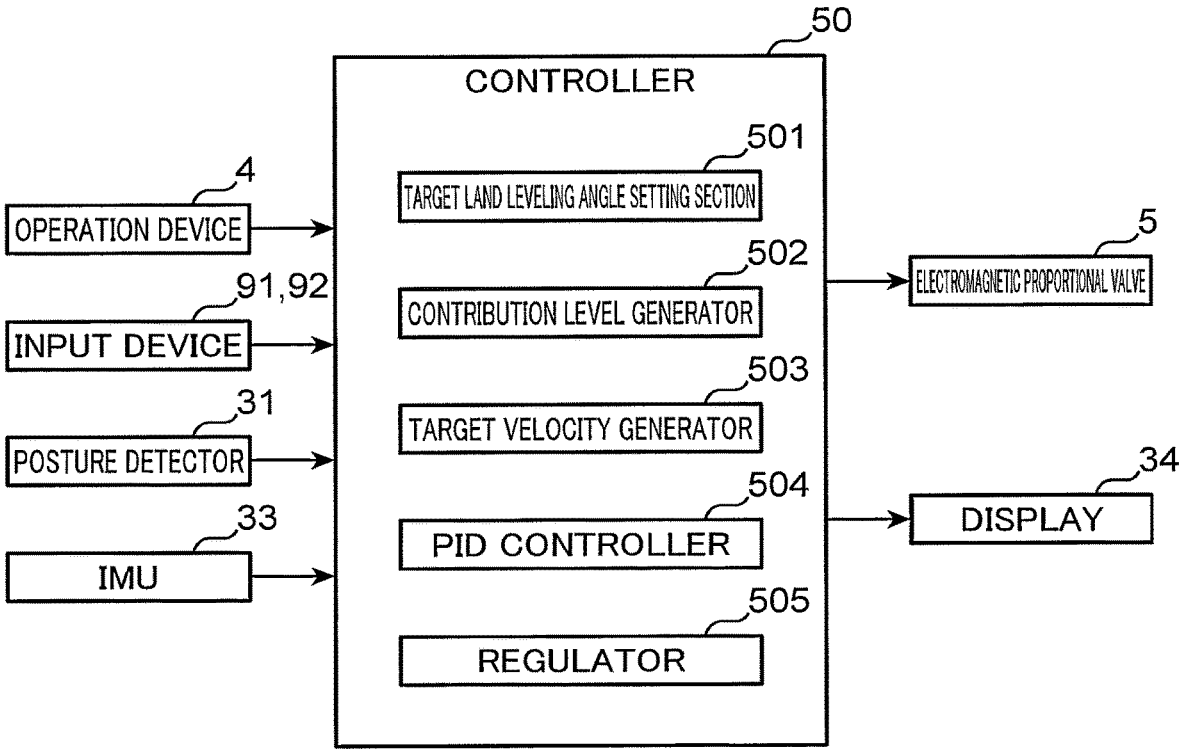
FIG. 3 is a block diagram of the drive control device according to the embodiment.

FIG. 3 is a block diagram of the drive control device according to the present embodiment. In the present embodiment, the controller 50 may be mounted, for example, in the cab on the upper slewing body 12. The controller 50 is provided with a computer, and each function is implemented by the computer executing a program. The computer includes, as a main hardware configuration, a processor that acts according to the program. The type of processor does not matter as long as the processor can implement functions by executing the program. Specifically, for example, the controller 50 includes a calculation processing unit such as a CPU and a memory such as a ROM that stores control programs and a RAM used as a work area for the calculation processing unit.

The controller 50 includes a target land leveling angle setting section 501, a contribution level generator 502 (velocity ratio generator), a target velocity generator 503, a PID controller 504, and a regulator 505. These are configured to function when the calculation processing unit executes the control program stored in the memory. The calculation process of the controller 50 will be described later.

Note that all or a part of the controller 50 is not limited to those provided in the hydraulic excavator 10, and may be disposed at a position different from the hydraulic excavator 10 in a case where the hydraulic excavator 10 is remotely controlled. The control program may be transmitted from a server (management device), a cloud, or the like at a remote location to the controller 50 in the hydraulic excavator 10 and executed, or the control program may be executed on the server or the cloud and various instruction signals generated may be transmitted to the hydraulic excavator 10.

The hydraulic excavator 10 further includes an input device 91, a posture detector 31, an inertial measurement unit (IMU) 33, and a display 34. The input device 91 is provided in the cab, and accepts input of information necessary for the control executed by the controller 50. Note that all or a part of the input device 91 is not limited to those provided in the hydraulic excavator 10, and may be disposed at a position different from the hydraulic excavator 10 in a case where the hydraulic excavator 10 is remotely controlled. The same applies to each of input devices 91A and 92, which will be described later.

The posture detector 31 detects information regarding the posture of the work device 13. Specifically, the posture detector 31 acquires relative posture information on the work device 13 with respect to the upper slewing body 12. As one example, the posture detector 31 includes three sensors mounted on the boom cylinder 17, the arm cylinder 18, and the bucket cylinder 19, and detects the stroke (expansion amount or length) of each cylinder. The stroke of each cylinder detected by each sensor is used to calculate the position and posture of the boom 14, the arm 15, and the bucket 16, and is further used to calculate the position and velocity of the composite center of gravity of the work device 13. Note that in order to calculate the position and posture of the boom 14, the arm 15, and the bucket 16, an angle sensor that detects the pivoting angle of each of the boom 14, the arm 15, and the bucket 16 may be used instead of the cylinder stroke sensor.

The IMU 33 detects information regarding the posture of the upper slewing body 12 with respect to the ground G. That is, the IMU 33 detects the posture and angle (inclination) of the body of the hydraulic excavator 10. As one example, the IMU 33 is mounted on the top of the cab. In the drive control device of the present disclosure, the IMU 33 may be omitted.

The display 34 is a display provided in the cab, and displays various pieces of information regarding the movement of the hydraulic excavator 10 and the control of the drive control device and notifies the operator. Note that all or a part of the display 34 is not limited to those provided in the hydraulic excavator 10, and may be disposed at a position different from the hydraulic excavator 10 in a case where the hydraulic excavator 10 is remotely controlled.

In the present embodiment, the controller 50 sets a target land leveling angle, which is the target for the land leveling angle in the land leveling work performed by the work device 13, calculates a pivoting member gravity center velocity, which is the velocity of the center of gravity of the pivoting member 20, calculates a target velocity, which is the target for the velocity of the composite center of gravity of the entire work device 13 by using the pivoting member gravity center velocity and the target land leveling angle, and controls the movement of the boom 14 to make the actual velocity of the composite center of gravity closer to the target velocity. In the present embodiment, since the pivoting member 20 includes the arm 15 and the bucket 16, the center of gravity of the pivoting member 20 is the composite center of gravity of the arm 15 and the bucket 16.

The movement of the entire work device 13 can be broken down into a component related to the movement of the boom 14 and a component related to the movement of the pivoting member 20. To level the construction surface to the target land leveling angle, it is required at least to cause the boom 14 and the pivoting member 20 to move in balance (ratio) according to the target land leveling angle. Therefore, in the drive control device according to the present embodiment, the controller 50 first calculates the pivoting member gravity center velocity, which is the velocity of the center of gravity of the pivoting member 20. The target for the velocity of the entire work device 13 corresponding to the pivoting member gravity center velocity (component related to the movement of the pivoting member 20) is determined according to the target land leveling angle. Therefore, the controller 50 can calculate the target velocity, which is the target for the velocity of the composite center of gravity of the entire work device 13 by using the pivoting member gravity center velocity and the target land leveling angle. When the target velocity of the entire work device 13 and the component related to the movement of the pivoting member 20 (pivoting member gravity center velocity) are determined, it is possible to use these to calculate the component related to the movement of the boom 14. That is, the controller 50 can control the movement of the boom 14 to make the actual velocity of the composite center of gravity of the entire work device 13 closer to the target velocity. Therefore, the drive control device can cause the work device 13 to move such that the construction surface is leveled to the target land leveling angle in the land leveling work. In the drive control device according to the present embodiment, by adjusting the boom operation based on the gravity center velocity, it is possible to reduce overloads and a decrease in the work velocity due to contact between earth and sand of the construction surface and the bucket 16, and even if the surface is rough, the land can be leveled efficiently.

The outline of the drive control device according to the present embodiment is as described above, and the control by the drive control device will be described below by citing specific examples. Note that the control by the drive control device of the present disclosure is not limited to the following specific example.

Figure 4:
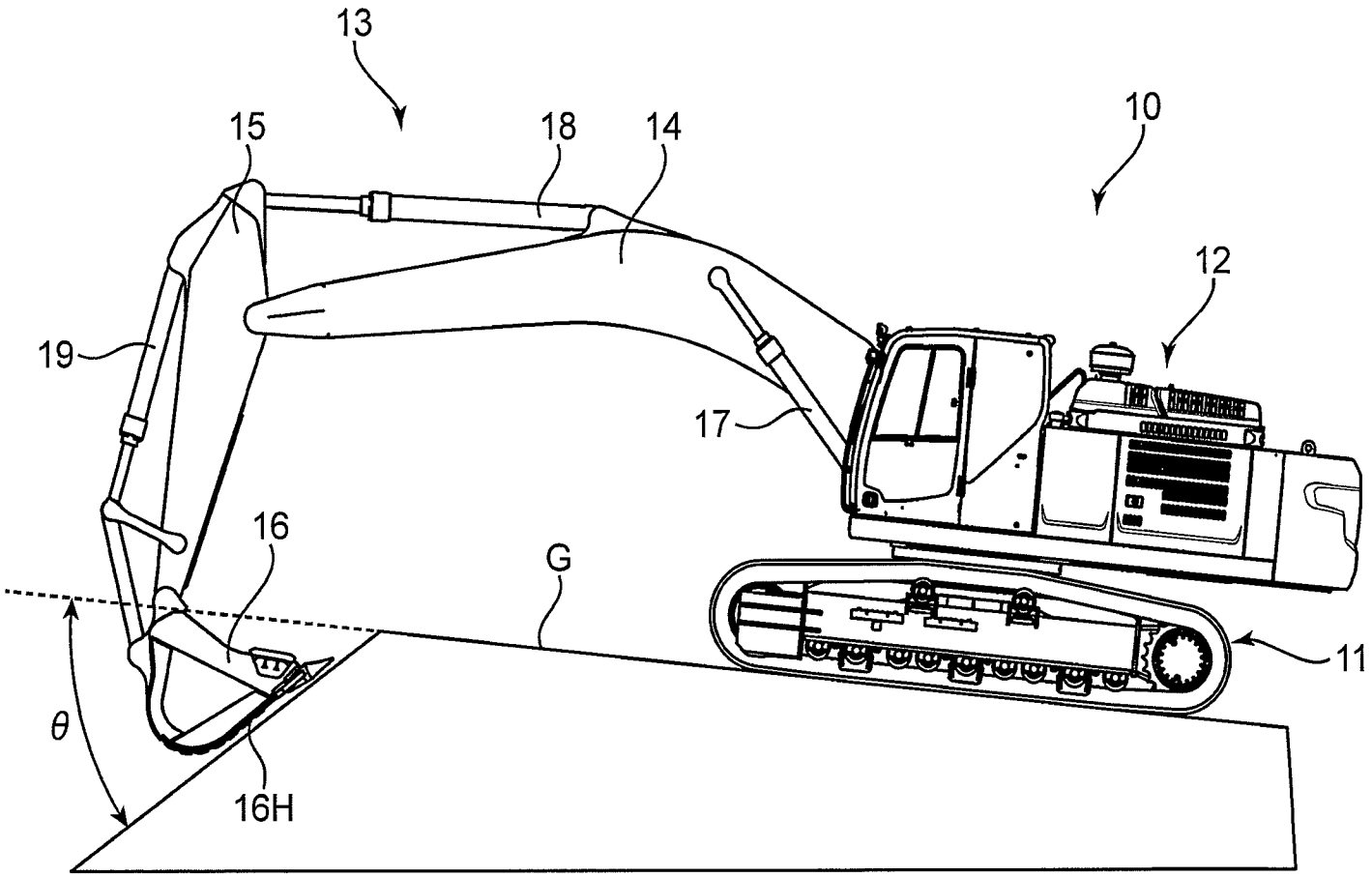
FIG. 4 is a side view showing one example of land leveling work performed by the construction machine according to the embodiment.
Figure 5:
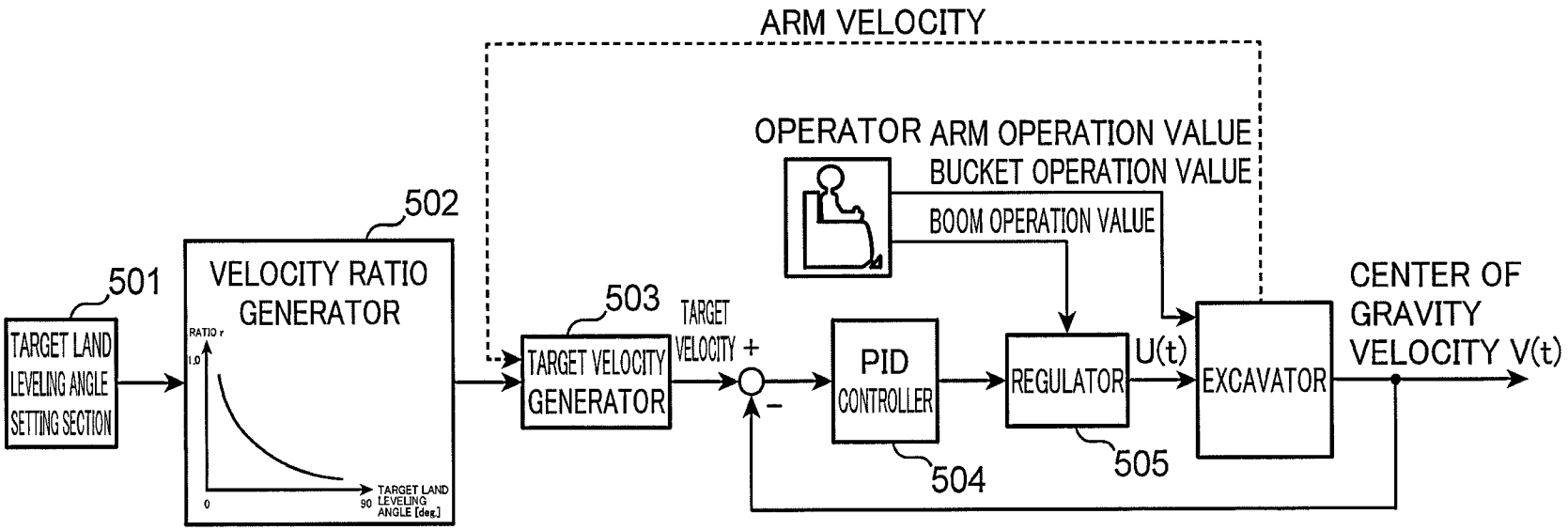
FIG. 5 is a block diagram of the drive control device according to the embodiment.
Figure 6:
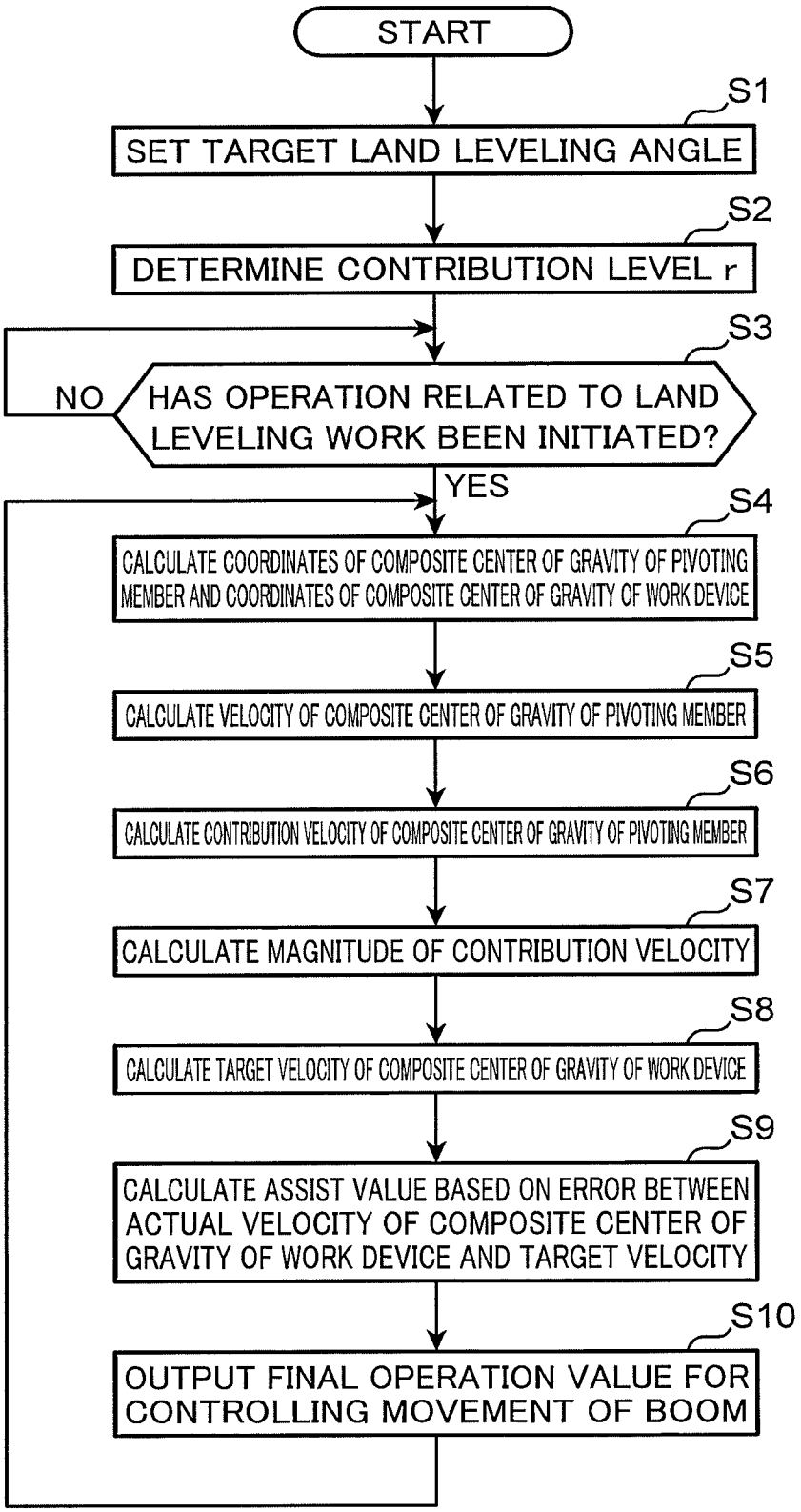
FIG. 6 is a flowchart showing a calculation process performed by a controller of the drive control device according to the embodiment.

FIG. 4 is a side view showing one example of land leveling work performed by the hydraulic excavator 10 according to the present embodiment. FIG. 5 is a block diagram of the drive control device according to the present embodiment. FIG. 6 is a flowchart showing the calculation process performed by the controller 50 of the drive control device.

The target land leveling angle setting section 501 of the controller 50 sets a target land leveling angle θ, which is a target for the land leveling angle in the land leveling work performed by the work device 13 (step S1 in FIG. 6). The target land leveling angle θ is the angle of the construction surface (target construction surface) with respect to the reference surface. In the present embodiment shown in FIG. 4, the target land leveling angle θ is the angle of the construction surface (target construction surface) with respect to the ground G (reference surface) where the lower travelling body 11 of the hydraulic excavator 10 is disposed. However, the reference surface is not limited to the ground G where the lower travelling body 11 is disposed, but may be a horizontal surface, for example.

Figure 7:
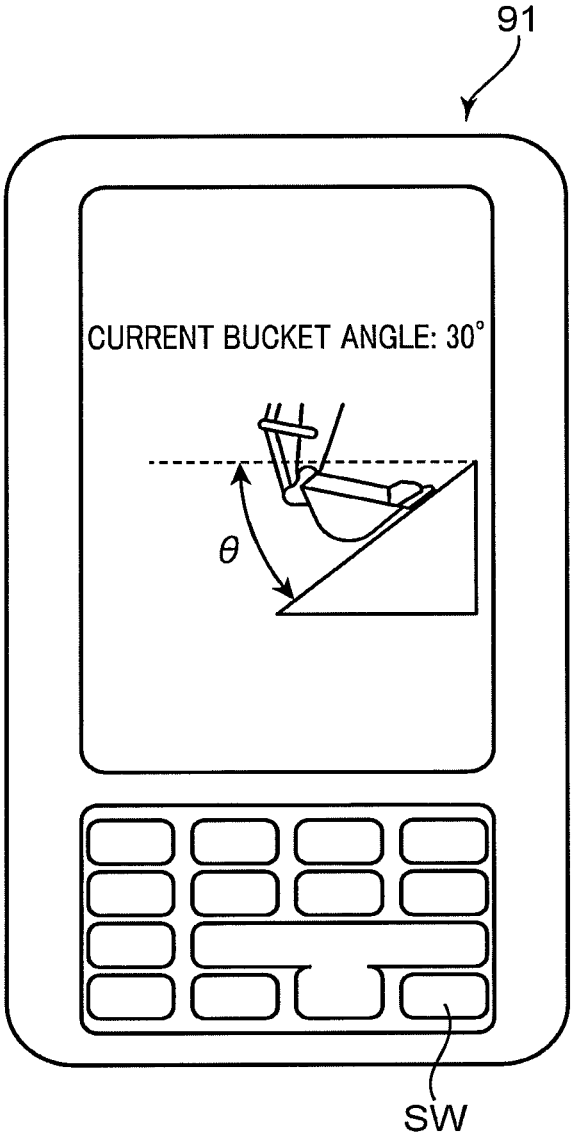
FIG. 7 is a plan view showing one example of an input device of the drive control device according to the embodiment.
Figure 8:
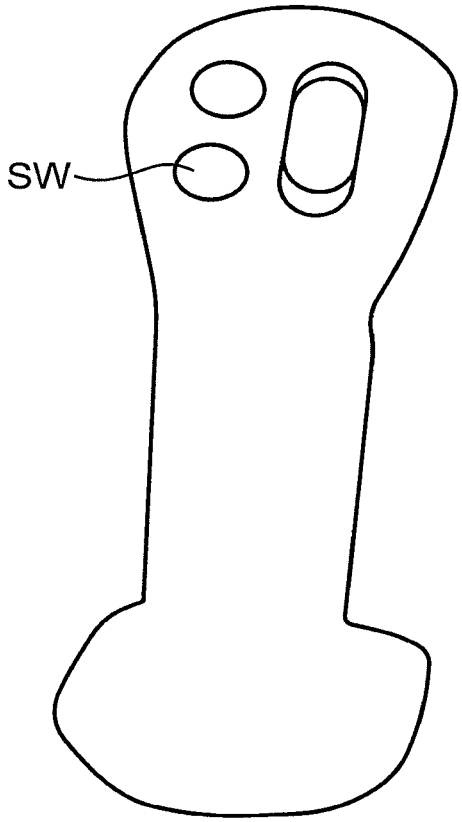
FIG. 8 is a perspective view showing another example of the input device of the drive control device according to the embodiment.

In the present embodiment, for example, as shown in FIG. 7, the input device 91 described above has a function as a setting input device 91A that receives input from the operator for setting the target land leveling angle θ. The setting input device 91A has a switch SW that can be pressed by the operator. The controller 50 sets the target land leveling angle θ based on the angle of the bucket bottom 16H of the bucket 16 (angle of the bottom of the bucket) with respect to the reference surface (for example, ground G) when input is made to the switch SW of the setting input device 91A, that is when the switch SW is pressed by the operator. The controller 50 can calculate the angle of the bucket 16 based on the posture information input from the posture detector 31. In the land leveling work, the operator can cause the controller 50 to set the target land leveling angle θ by simply placing the bucket 16 at a desired angle to be set as the target land leveling angle θ on or near the construction surface, and making input into the setting input device 91A. This allows the operator to omit the work of inputting the numerical value of the target land leveling angle θ. The setting input device 91A shown in FIG. 7 includes a display that displays a current diagram or video of the bucket 16 along with angle information on the bucket 16 (angle information with respect to the reference surface). Therefore, the operator can adjust the angle of the bucket 16 to the target land leveling angle θ while looking at the display. Note that the switch SW of the setting input device 91A may be placed, for example, on an operating lever of the operation device 4 as shown in FIG. 8. Alternatively, the operator may perform work to input the numerical value of the target land leveling angle θ, and the controller 50 may set the target land leveling angle θ based on the input value.

Figure 9:
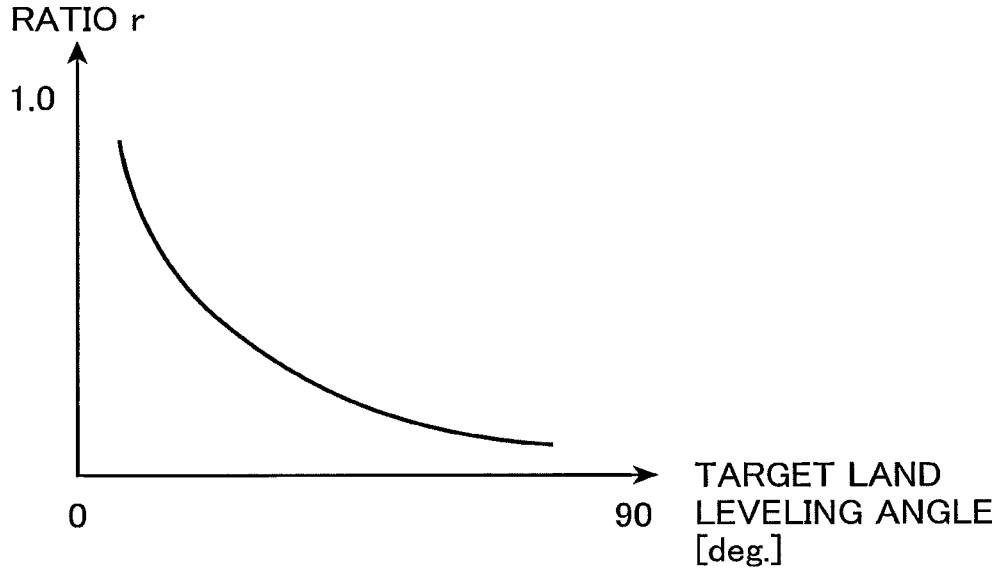
FIG. 9 is a graph showing one example of a map set in advance in the drive control device according to the embodiment.

Next, the contribution level generator 502 (velocity ratio generator) of the controller 50 determines the contribution level r that the movement of the pivoting member 20 should account for in the movement of the entire work device 13 in the land leveling work to have a larger value when the target land leveling angle θ is small than when the target land leveling angle θ is large (step S2). Specifically, the controller 50 stores in advance, for example, the map as shown in FIG. 9. The map is a graph showing the relationship between the target land leveling angle θ and the contribution level r (ratio r). The map in FIG. 9 can be represented as a relational expression such that the contribution level r has a larger value when the target land leveling angle θ is small than when the target land leveling angle θ is large.

More specifically, the map in FIG. 9 can be represented as a relational expression such that as the target land leveling angle θ decreases, the contribution level r has a larger value. The map in FIG. 9 can be created from the following viewpoint.

In a case of moving the bucket 16 along the construction surface when the target land leveling angle θ is small, the velocity component of the pivoting member 20 that moves in the front-back direction with respect to the body of the hydraulic excavator 10 (for example, upper slewing body 12) increases, and the velocity component of the pivoting member 20 that moves in the vertical direction with respect to the body decreases. That is, in this case, since the amount of movement of the boom 14 that moves the pivoting member 20 up and down is relatively small, the map is set such that the velocity component of the pivoting member 20 accounts for most of the velocity of the entire work device 13.

Meanwhile, in a case of moving the bucket 16 along the construction surface when the target land leveling angle θ is large, the velocity component of the pivoting member 20 that moves in the front-back direction with respect to the body decreases, and the velocity component of the pivoting member 20 that moves in the vertical direction with respect to the body increases. That is, in this case, since the amount of movement of the boom 14 that moves the pivoting member 20 up and down is relatively large, the map is set such that the proportion of the velocity component of the pivoting member 20 to the velocity of the entire work device 13 decreases.

The contribution level generator 502 calculates the contribution level r based on the map in FIG. 9 and the set target land leveling angle θ.

Next, the controller 50 determines whether an operation related to the land leveling work has been initiated (step S3). Specifically, for example, in the land leveling work with the target land leveling angle θ set as shown in FIG. 4, the operator performs the arm pulling operation and the boom raising operation simultaneously. Therefore, when an operation signal indicating that the arm pulling operation and the boom raising operation are performed simultaneously is input to the controller 50, the controller 50 determines that the operation related to the land leveling work has been initiated (YES in step S3). Note that the controller 50 may determine that the operation related to the land leveling work has been initiated by either the boom raising operation or the arm pulling operation.

Next, the target velocity generator 503 of the controller 50 calculates the coordinates of the composite center of gravity of the pivoting member 20 and the coordinates of the composite center of gravity of the entire work device 13 based on the posture information input from the posture detector 31 (step S4).

As shown in FIG. 1, with a pivoting base end section of the boom 14 of the work device 13 as origin 0, the Y coordinates are defined in the vertical direction, the X coordinates are defined in the horizontal direction, the mass of the boom 14 is defined as m1, the coordinates of the center of gravity $g_1$ of the boom 14 are defined as ($x_1$(t), $y_1$(t)), the mass of the arm 15 is defined as m2, the coordinates of the center of gravity g2 of the arm 15 are defined as ($x_2$ (t), $y_2$ (t)), the mass of the bucket 16 is defined as m3, and the coordinates of the center of gravity g3 of the bucket 16 are defined as ($x_3$(t), $y_3$(t)). Note that each coordinate, which varies as the work device 13 moves, is represented as a variable of time t. In this case, the coordinates ($X_{G23}$(t), $Y_{G23}$(t)) of the composite center of gravity g23 of the pivoting member 20 are represented, for example, by the following formula (1), and the coordinates ($X_g$(t), $Y_g$(t)) of the composite center of gravity g of the work device 13 are represented by the following formula (2).

[Formula 1]

$$(X_{G23}(t),\ Y_{G23}(t)) = \left(\frac{m_2x_2(t) + m_3x_3(t)}{m_2 + m_3},\ \frac{m_2y_2(t) + m_3y_3(t)}{m_2 + m_3}\right) \tag{1}$$

[Formula 2]

$$(X_G(t),\ Y_G(t)) = \left(\frac{m_1x_1(t) + m_2x_2(t) + m_3x_3(t)}{m_1 + m_2 + m_3},\ \frac{m_1y_1(t) + m_2y_2(t) + m_3y_3(t)}{m_1 + m_2 + m_3}\right) \tag{2}$$

Next, the target velocity generator 503 calculates the velocity of the composite center of gravity g23 of the pivoting member 20 by using the following formula (3) (step S5).

[Formula 3]

$$(V_{XG23}(t),\ V_{YG23}(t)) = \left(\frac{dX_{G23(t)}}{dt},\ \frac{dY_{G23(t)}}{dt}\right) \tag{3}$$

Next, the target velocity generator 503 calculates a contribution velocity, which represents how much the velocity of the composite center of gravity g23 of the pivoting member 20 should contribute, out of the velocity of the composite center of gravity g of the work device 13 (step S6). The target velocity generator 503 can calculate the contribution velocity ($V_{XG}$(t), $V_{YG}$(t)), for example, by using the following formula (4). This contribution velocity (pivoting member velocity) replaces the movement of the pivoting member 20 with the velocity of the composite center of gravity g of the entire work device 13.

[Formula 4]

$$(V_{XG}(t),\ V_{YG}(t)) = \left(\frac{(m_2 + m_3)V_{XG23}(t)}{m_1 + m_2 + m_3},\ \frac{(m_2 + m_3)V_{YG23}(t)}{m_1 + m_2 + m_3}\right) \tag{4}$$

Next, the target velocity generator 503 calculates the contribution velocity $V'_G$(t), which is the magnitude of the contribution velocity ($V_{XG}$(t), $V_{YG}$(t)) by using the following formula (5) (step S7).

[Formula 5]

$$V'_G(t) = \sqrt{V_{XG}(t)^2 + V_{YG}(t)^2} \tag{5}$$

Next, the target velocity generator 503 calculates the target velocity $V_r$(t) of the composite center of gravity g of the entire work device 13 by using the contribution velocity $V'_G$(t), the contribution level r, and the following formula (6) (step S8).

[Formula 6]

$$V_r(t) = \frac{V'_G(t)}{r} \tag{6}$$

Next, the controller 50 feedback-controls the actual velocity V(t) of the composite center of gravity g of the work device 13 to follow the above-mentioned target velocity $V_r$(t), whereby the boom operation value, which is a value according to the operation amount of operation given to the boom operation device of the operation device 4, is adjusted, and as a result, the movement of the work device 13 is controlled such that the bucket 16 of the work device 13 moves along the target land leveling angle θ. The controller 50 calculates the actual velocity V(t) of the composite center of gravity g of the work device 13 by using, for example, the following formulas (7) and (8).

[Formula 7]

$$(V_X(t),\ V_Y(t)) = \left(\frac{dX_G(t)}{dt},\ \frac{dY_G(t)}{dt}\right) \tag{7}$$

[Formula 8]

$$V(t) = \sqrt{V_X(t)^2 + V_Y(t)^2} \tag{8}$$

Specifically, the PID controller 504 of the controller 50 calculates a boom correction value u(t) that is an assist value that brings the error e (t) between the target velocity $V_r$(t) and the actual velocity V(t) of the composite center of gravity g of the work device 13 close to zero by using the following formulas (9) and (10) (step S9). Note that in formula (9), Kp, Ki, and Kd are proportional gain, integral gain, and differential gain, respectively. In formula (9), u(t−1) is operation input (control input value) calculated in the previous calculation process in step S9 or step S10, that is, the previous value.

[Formula 9]

$$u(t) = u(t-1) + K_p\Delta e(t) + K_i e(t) + K_d\Delta^2 e(t) \quad (9)$$

[Formula 10]

$$e(t) = V_r(t) - V(t) \quad (10)$$

The controller 50 may input the calculated boom correction value u(t) as it is as the control input value into the electromagnetic proportional valve 5 corresponding to the boom raising operation (step S10), but may use, for example, the boom operation value and the boom correction value u(t) in the regulator 505 of the controller 50 as follows to calculate the final control input value for controlling the movement of the boom 14 and input the calculated control input value into the electromagnetic proportional valve 5 corresponding to the boom raising operation (step S10). By inputting any control input value as described above into the electromagnetic proportional valve 5, the movement of the arm (movement of the pivoting member) and the movement of the boom can be represented on the same index, the center of gravity.

Next, a specific example of the calculation process performed by the regulator 505 will be described. As described with reference to FIG. 5, by feedback-controlling the velocity V(t) of the composite center of gravity g of the entire work device 13 to follow the target velocity Vr(t), the boom correction value u(t) is calculated by the controller 50. Here, the boom operation value, which is a value according to the operation amount of operation given to the boom operation device by the operator, is represented as "uh(t)", and the boom correction value calculated by the controller 50 in step S9 is represented as "uc(t)". The regulator 505 of the controller 50 adjusts the final control input value u(t) from the boom operation value uh(t) and the boom correction value uc(t), and inputs the control input value u(t) into the electromagnetic proportional valve 5 corresponding to the boom raising operation. This allows the operator to easily perform operations related to the land leveling work because the work device 13 performs the boom raising movement and the arm pulling movement in balance that aligns with the target land leveling angle θ.

The regulator 505 may adjust the boom correction value u(t) based on the following formula (11), for example. That is, as shown in formula (11), the regulator 505 may select smaller one of the boom operation value uh(t) and the boom correction value uc(t), and input the selected value into the electromagnetic proportional valve 5 as the control input value u(t). The regulator 505 may, triggered by the operator's operation, input the boom correction value uc(t) calculated by the controller 50 as it is to the electromagnetic proportional valve 5 as the control input value u(t). The regulator 505 may calculate a value obtained by adding the boom operation value uh(t) and the boom correction value uc(t) together at a fixed ratio, and input this value to the electromagnetic proportional valve 5 as the control input value u(t).

[Formula 11]

$$u(t) = \min(u_c(t), u_h(t)) \quad (11)$$

The drive control device according to the embodiment of the present disclosure and the hydraulic excavator 10 provided with the same have been described above, but the present disclosure is not limited to the embodiment, and includes the following modifications, for example.

First Modification

Figure 10:
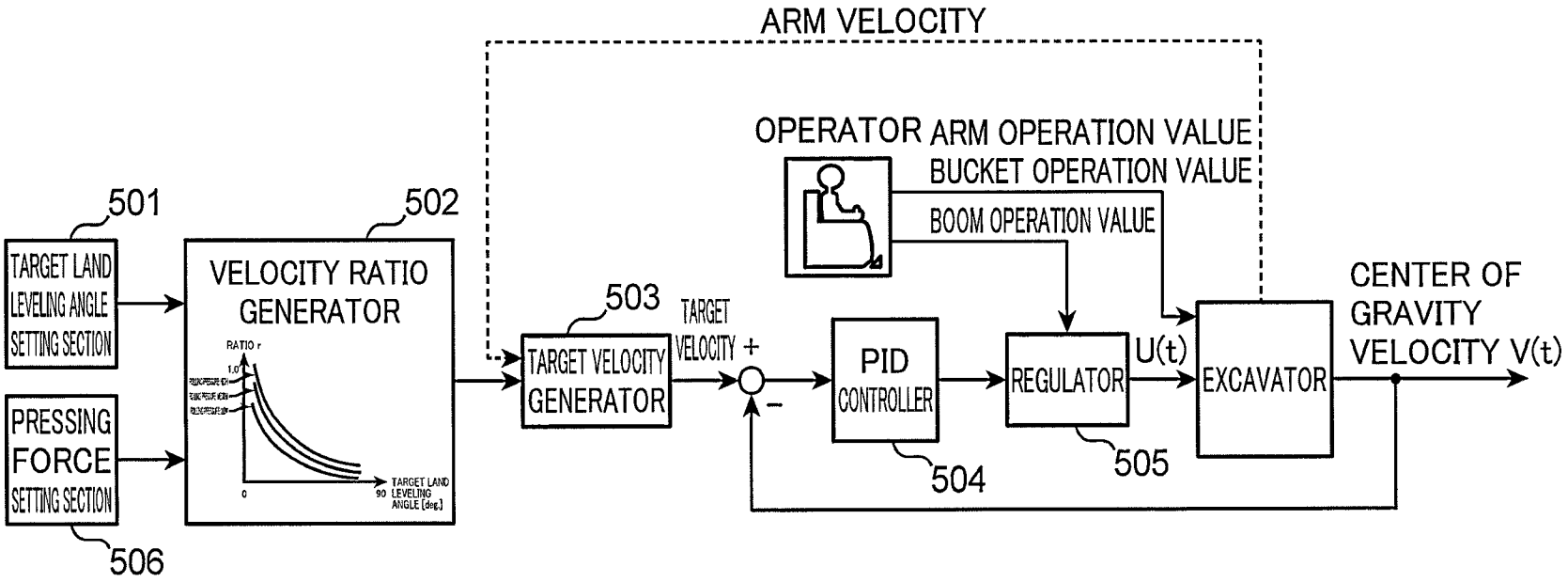
FIG. 10 is a block diagram of the drive control device according to a first modification of the embodiment.

FIG. 10 is a block diagram of the drive control device according to a first modification of the embodiment. The drive control device according to the first modification further includes a compacting pressure input device 92 (pressing force input device 92) that receives input for adjusting the compacting pressure, which is the strength of force the pivoting member 20 applies to the ground G in the land leveling work (see FIG. 3). The controller 50 increases or decreases the contribution level based on the input to the compacting pressure input device 92. Specifically, this will be described as follows.

The compacting pressure input device 92 may be, for example, an input device similar to the setting input device 91A described above. The controller 50 further includes a compacting pressure setting section 506 (pressing force setting section 506). The compacting pressure setting section 506 increases or decreases the contribution level based on the input made by the operator and received by the compacting pressure input device 92. Specifically, this will be described as follows.

Figure 11:
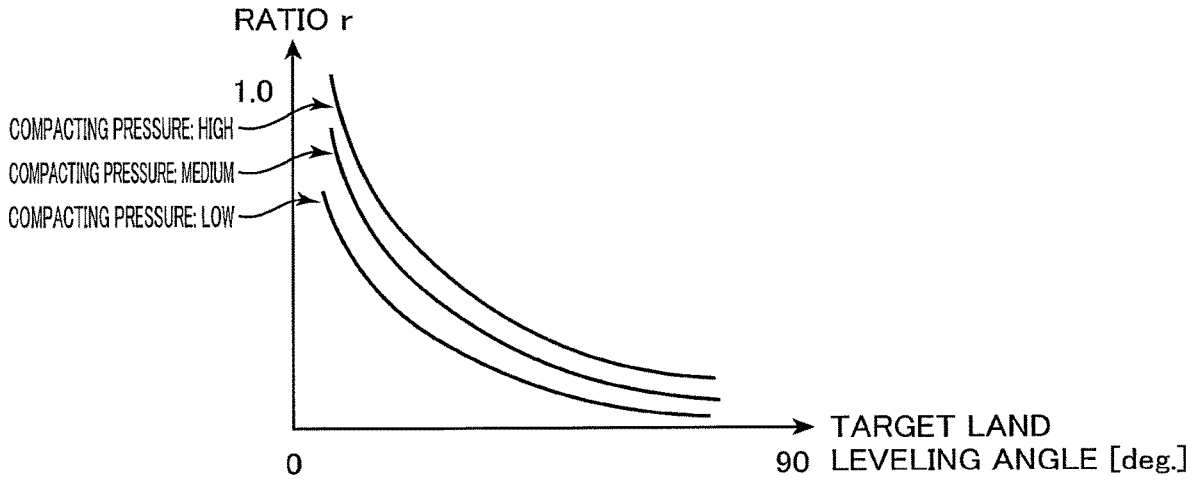
FIG. 11 is a graph showing one example of a map set in advance in the drive control device according to the first modification of the embodiment.

FIG. 11 is a graph showing one example of maps set in advance in the drive control device according to the first modification. In the specific example shown in FIG. 11, the controller 50 stores a plurality of maps corresponding to a plurality of levels of compacting pressure (compacting pressure of three levels: high, medium, and low in FIG. 11).

In the first modification, in the map "compacting pressure: high", the contribution level that the movement of the pivoting member 20 accounts for in the movement of the entire work device 13 is increased, compared to the map "compacting pressure: medium". In the map "compacting pressure: low", the contribution level that the movement of the pivoting member 20 accounts for in the movement of the entire work device 13 is decreased, compared to the map "compacting pressure: medium".

Specifically, when the contribution level that the movement of the pivoting member 20 accounts for in the movement of the entire work device 13 is increased, the velocity component of the pivoting member 20 moving in the front-back direction with respect to the body of the hydraulic excavator 10 increases, and the velocity component of the pivoting member 20 moving in the vertical direction with respect to the body of the hydraulic excavator 10 decreases. This causes the work device 13 to move in balance that aligns with a gentler inclination than the surface determined according to the target land leveling angle θ (angle smaller than the target land leveling angle θ), making it possible to enhance the compacting pressure when the boom raising movement and the arm pulling movement are performed.

When the contribution level that the movement of the pivoting member 20 accounts for in the movement of the entire work device 13 is decreased, the velocity component of the pivoting member 20 moving in the front-back direction with respect to the body of the hydraulic excavator 10 decreases, and the velocity component of the pivoting member 20 moving in the vertical direction with respect to the body of the hydraulic excavator 10 increases. This causes the work device 13 to move in balance that aligns with a steeper inclination than the surface determined according to the target land leveling angle θ (angle larger than the target land leveling angle θ), making it possible to lower the compacting pressure when the boom raising movement and the arm pulling movement are performed.

For example, when the operator makes an input corresponding to one of the compacting pressure "high", "medium", or "low" into the compacting pressure input device 92, the controller 50 selects the map corresponding to the input from among the plurality of maps (for example, map of the compacting pressure "high"). Then, the contribution level generator 502 of the controller 50 calculates the contribution level r based on the map selected from among the plurality of maps in FIG. 11 and the set target land leveling angle θ. This allows the contribution level to be changed and the compacting pressure to be adjusted.

Second Modification

Figure 12:
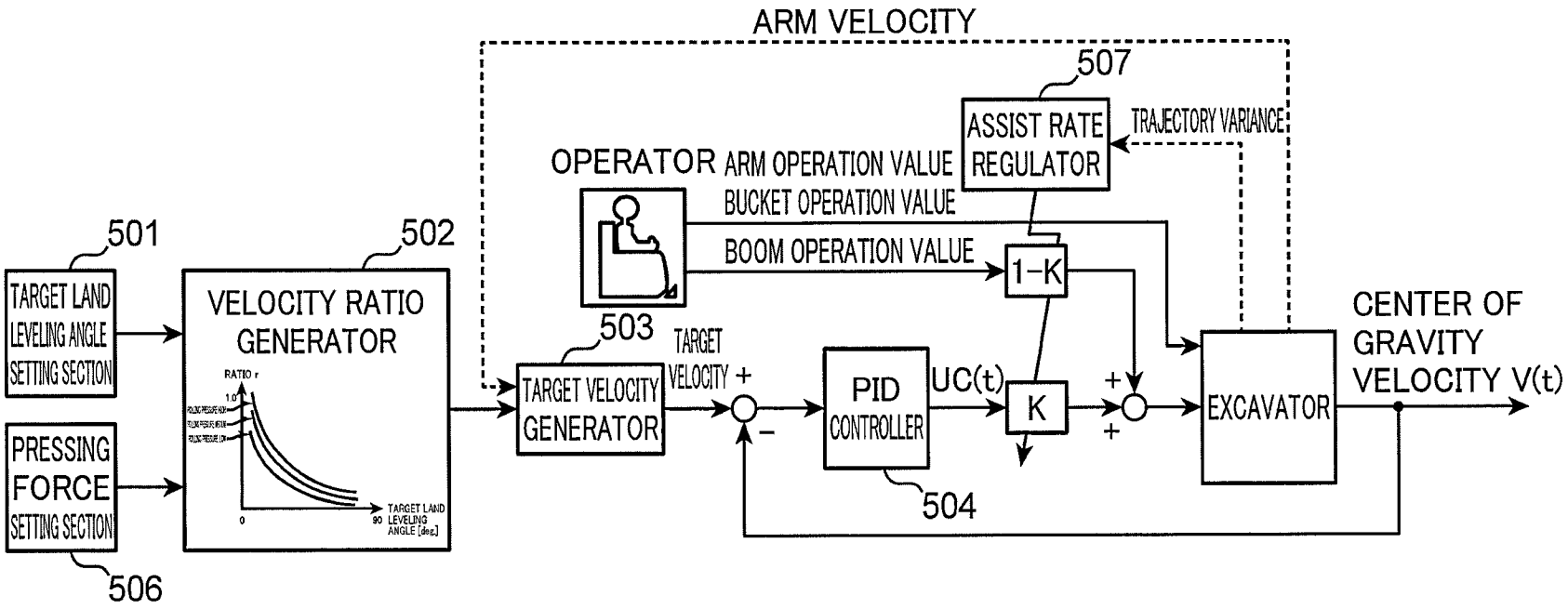
FIG. 12 is a block diagram of the drive control device according to a second modification of the embodiment.
Figure 13:
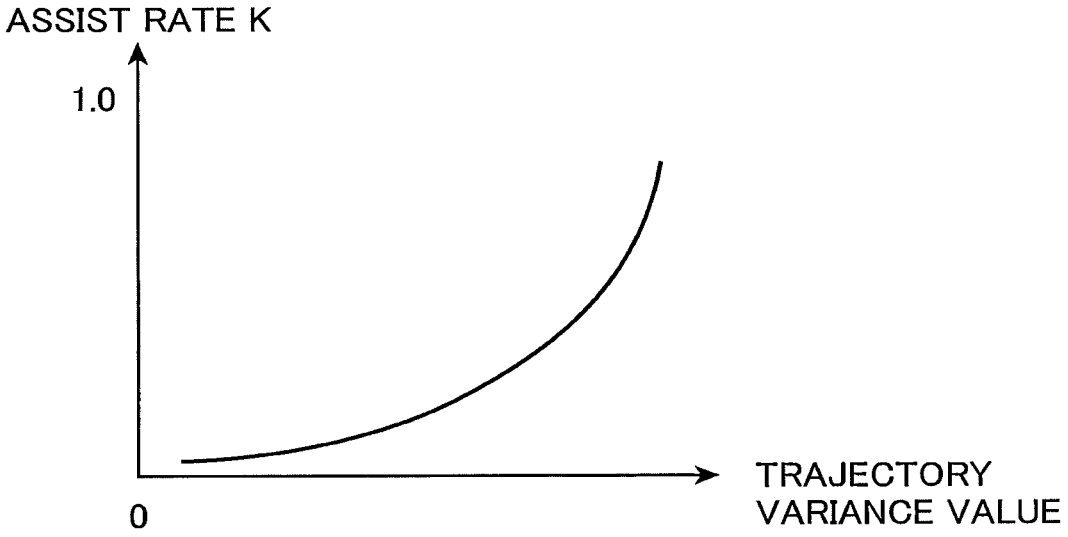
FIG. 13 is a graph showing one example of a map set in advance in the drive control device according to the second modification of the embodiment.
Figure 14:
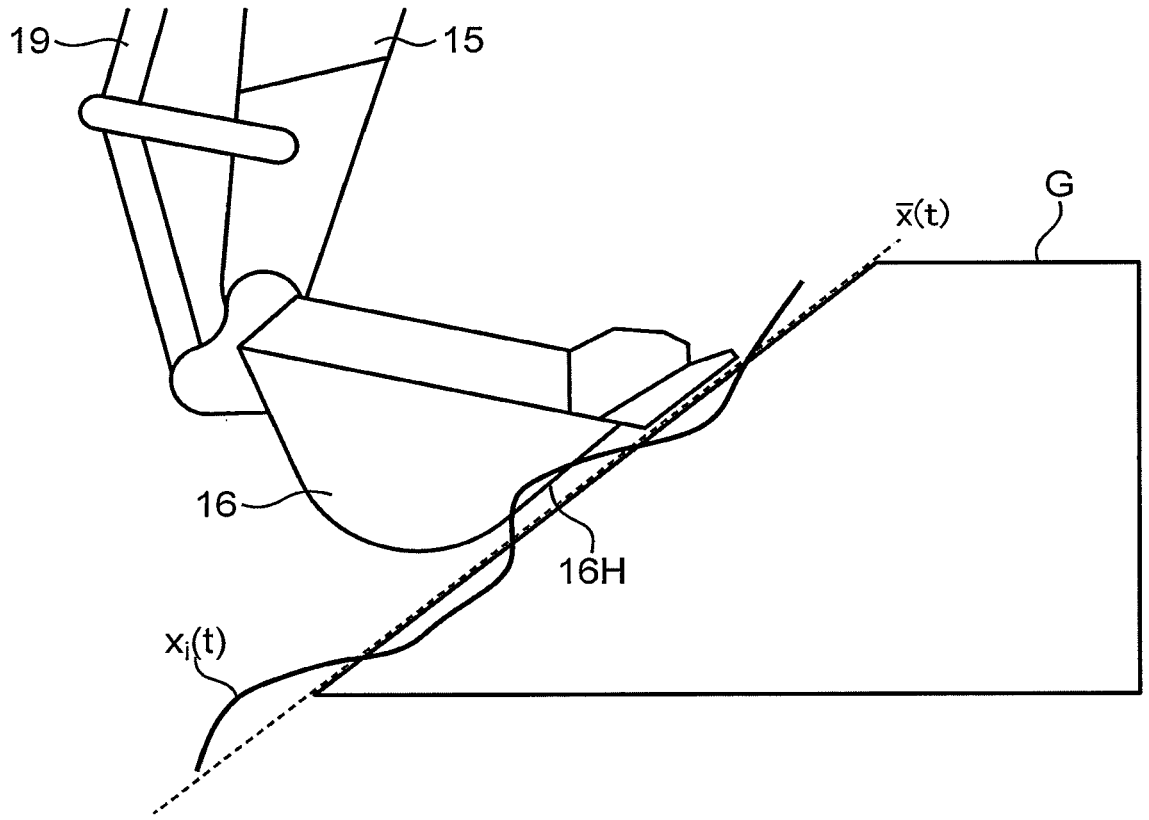
FIG. 14 is a side view showing one example of a trajectory of a tip member of a work device in the second modification of the embodiment.

FIG. 12 is a block diagram of the drive control device according to a second modification of the embodiment. FIG. 13 is a graph showing one example of the map set in advance in the drive control device according to the second modification. FIG. 14 is a side view showing one example of a trajectory of the bucket 16 (tip member) of the work device 13 in the second modification.

In the second modification, the controller 50 calculates the boom correction value for moving the boom 14 to make the actual velocity of the composite center of gravity g of the entire work device 13 closer to the target velocity, and controls the movement of the boom 14 by using the boom operation value according to the operation amount of the boom operation and the boom correction value. At this time, the controller 50 calculates the control input value for controlling the movement of the boom 14 by using the boom operation value and the boom correction value, such that the ratio of the boom correction value to the boom operation value is higher when the operating skill of the operator about the land leveling work is low as compared with when the operating skill is high. In the second modification, when the operating skill of the operator is high, it is possible to perform the land leveling work according to the preference of a skilled worker with less assistance provided by the controller 50. Meanwhile, when the operating skill of the operator is low, by increasing the degree of assistance provided by the controller 50, even an unskilled worker can increase the work efficiency of the land leveling work. Specifically, this will be described as follows.

In the second modification, the controller 50 further includes an assist rate regulator 507. The controller 50 stores in advance skill data that is data about the operating skill of the operator who performs the land leveling work, for example, as shown in FIG. 14. The skill data may be, for example, as shown in FIG. 14, dispersion of the trajectory xi(t) of a preset specific part in the bucket 16 (for example, tip of the bucket 16) with respect to the target surface xbar(t) as a reference when the operator actually performs the land leveling work. Here, "xbar(t)" represents the target surface shown by the broken line in FIG. 14, corresponding to the symbol with a horizontal line above the "x" of the characters "x(t)" in FIG. 14. Such dispersion may be a variance value V, a standard deviation, or another index. The target surface xbar(t) is a surface determined according to the target land leveling angle θ. When the skill data has a variance value V and the number of data in the land leveling work is n, the controller 50 can calculate the variance value V based on the following formula (12), for example.

[Formula 12]

$$V = \frac{1}{n}\sum_{i=1}^{n}(x_i(t) - \overline{x}(t))^2 \tag{12}$$

The controller 50 can acquire data on the trajectory xi(t) based on the known dimensions of the boom 14, the arm 15, and the bucket 16 of the work device 13, and the posture information input from the posture detector 31 to the controller 50.

The assist rate regulator 507 of the controller 50 sets an assist rate K based on the data regarding the operating skill of the operator, for example, the variance value V of the trajectory xi (t) of a specific part as described above (trajectory variance value) and the map shown in FIG. 13. In the second modification, the assist rate K is set to a value of 0 or more and 1 or less, for example.

Then, the controller 50 calculates the final control input value u(t) by adding the value obtained by multiplying the boom operation value uh(t) by "1-K" and the value obtained by multiplying the boom correction value uc(t) by "K". The controller 50 inputs the calculated control input value u(t) to the electromagnetic proportional valve 5 corresponding to the boom raising operation. This allows the controller 50 to assist the operator in the operation according to the operating skill of the operator.

Note that the operating skill of the operator does not have to be stored in advance in the controller 50 before the land leveling work as in the specific example described above. That is, the controller 50 may be configured to acquire the data regarding the operating skill of the operator while controlling the assist by the controller 50 according to the present disclosure when the land leveling work is performed. The operating skill of the operator is not limited to the data on dispersion such as the variance value V and the standard deviation as described above, but may be another data that allows determination of the operating skill.

Note that the controller 50 may determine the assist rate K based on the soil quality of the target ground of the land leveling work, and may determine the assist rate K based on the work velocity of the land leveling work. Specifically, the controller 50 may calculate the control input value for controlling the movement of the boom by using the boom operation value and the boom correction value, such that the ratio of the boom correction value to the boom operation value is higher when the soil quality of the ground is difficult to level than when the soil quality is easy to level. The controller 50 may calculate the control input value for controlling the movement of the boom by using the boom operation value and the boom correction value, such that the ratio of the boom correction value to the boom operation value is higher when the work velocity is low (for unskilled worker) than when the work velocity is high (for skilled worker).

Figure 15:
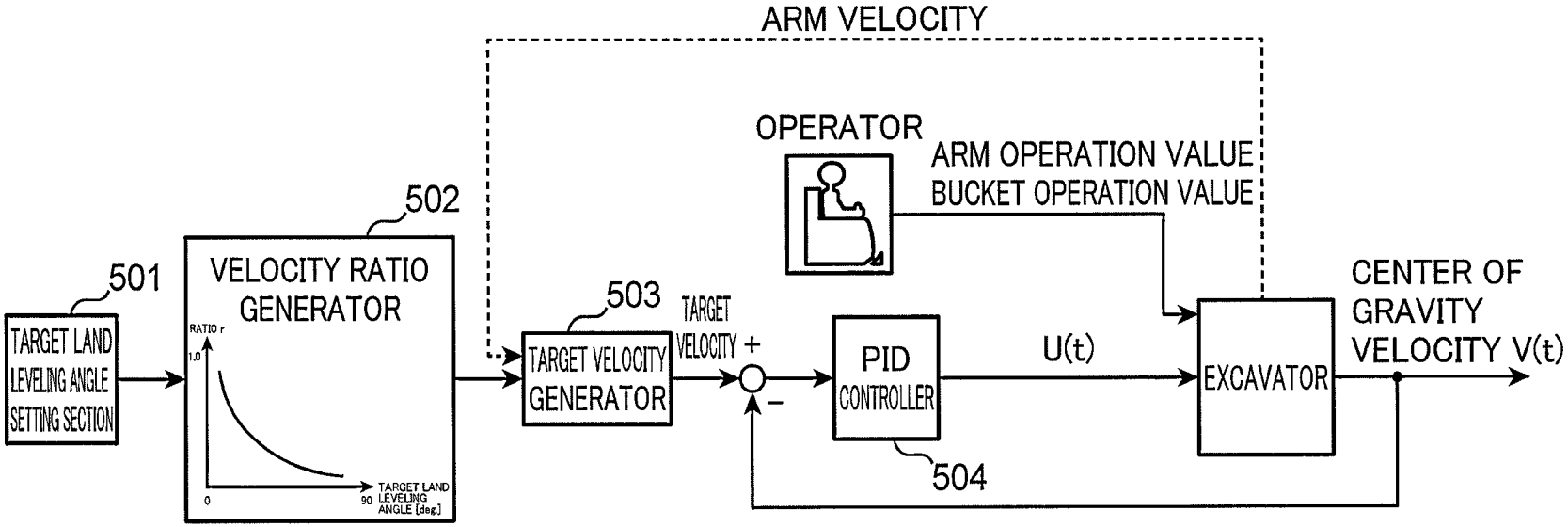
FIG. 15 is a block diagram of the drive control device according to a third modification of the embodiment.

FIG. 15 is a block diagram of the drive control device according to a third modification of the embodiment. As shown in FIG. 15, in the third modification, the controller 50 calculates the final control input value u(t) without considering the boom operation value of the boom operation by the operator. That is, in the third modification, the movement of the boom 14 is automatically controlled by the controller 50. Therefore, the operator can perform the land leveling work by performing only the arm pulling operation and the bucket operation.

Next, a fourth modification of the embodiment will be described. In the fourth modification, the controller 50 calculates the final control input value u(t) without considering the operation value of the bucket operation by the operator (bucket operation value). The bucket operation value is a value according to the operation given to the bucket operation device of the operation device 4. In the fourth modification, the movement of the bucket 16 is automatically controlled by the controller 50. The controller 50 performs control to maintain the angle of the bucket bottom 16H at the target land leveling angle θ by feedback-controlling the angle of the bucket bottom 16H of the bucket 16 to follow the target land leveling angle θ described above. Specifically, for example, by monitoring the angle of the bucket bottom 16H by using the pivoting angles of the boom 14, the arm 15, and the bucket 16 detected by the posture detector 31, the controller 50 calculates the amount of deviation of the angle of the bucket bottom 16H from the target land leveling angle θ, and inputs the instruction signal into the electromagnetic proportional valve 5 such that this amount of deviation is resolved by pivoting the bucket 16. Therefore, the operator can perform the land leveling work without performing the bucket operation.

Next, a fifth modification of the embodiment will be described. In the embodiment described above, when the arm pulling operation and the boom raising operation are performed simultaneously, the controller 50 determines whether the operation related to the land leveling work has been initiated (step S3 in FIG. 6), but this is not restrictive. In the fifth modification, the controller 50 may determine that the operation related to the land leveling work has been initiated even if the arm pushing operation and the boom lowering operation are performed simultaneously. In this case, the boom lowering movement and the arm pushing movement are performed in balance that the bucket 16 of the work device 13 aligns with the target land leveling angle θ, allowing the operator to easily perform the land leveling work. Note that in the fifth modification, the controller 50 may determine that the operation related to the land leveling work has been initiated by either the boom lowering operation or the arm pushing operation.

Next, a sixth modification of the embodiment will be described. In the sixth modification, the controller 50 performs control to correct the target land leveling angle θ according to the posture and angle (inclination) of the body of the hydraulic excavator 10 detected by the IMU 33. Specifically, for example, the operator may move the position of the hydraulic excavator 10 during the land leveling work (for example, move back or forth). Since the inclination of the work site is not necessarily uniform, as a result of moving the position of the hydraulic excavator 10, the angle of the hydraulic excavator 10 with respect to the reference surface may change and the set target land leveling angle θ may change. Therefore, in the sixth modification, by storing the angle of the hydraulic excavator 10 with respect to the reference surface at the time when the target land leveling angle θ is set, even if the angle of the hydraulic excavator 10 with respect to the reference surface changes, the target land leveling angle θ is corrected in consideration of the change.

As described above, the present disclosure provides a drive control device that allows the work device to move in the land leveling work such that the construction surface is leveled to the target land leveling angle and a construction machine provided with the same.

The present disclosure provides a drive control device for a construction machine including: a body; and a work device including a boom supported by the body to allow a derricking movement and a pivoting member pivotably supported by the boom, the drive control device including a controller that controls a movement of the work device, the controller: sets a target land leveling angle that is a target for a land leveling angle in land leveling work performed by the work device; calculates a pivoting member gravity center velocity that is a velocity of a center of gravity of the pivoting member; calculates a target velocity that is a target for a velocity of a composite center of gravity of the entire work device by using the pivoting member gravity center velocity and the target land leveling angle; and controls a movement of the boom to make an actual velocity of the composite center of gravity closer to the target velocity.

The movement of the entire work device can be broken down into a component related to the movement of the boom and a component related to the movement of the pivoting member. To level the construction surface to the target land leveling angle, it is required at least to cause the boom and the pivoting member to move in balance (ratio) according to the target land leveling angle. Therefore, in the drive control device, the controller first calculates the pivoting member gravity center velocity, which is the velocity of the center of gravity of the pivoting member. The target for the velocity of the entire work device corresponding to the pivoting member gravity center velocity (that is, component related to the movement of the pivoting member) is determined according to the target land leveling angle. Therefore, the controller can calculate the target velocity, which is the target for the velocity of the composite center of gravity of the entire work device by using the pivoting member gravity center velocity and the target land leveling angle. When the target velocity of the composite center of gravity of the entire work device and the component related to the movement of the pivoting member (that is, pivoting member gravity center velocity) are determined, it is possible to use these to calculate the component related to the movement of the boom. That is, the controller can control the movement of the boom to make the actual velocity of the composite center of gravity of the entire work device closer to the target velocity. Therefore, the drive control device can cause the work device to move such that the construction surface is leveled to the target land leveling angle in the land leveling work.

Specifically, the ratio between the movement of the pivoting member and the movement of the boom for leveling the construction surface to the target land leveling angle in the land leveling work, in other words, the contribution level that the movement of the pivoting member accounts for in the movement of the entire work device has a larger value when the target land leveling angle is small than when the target land leveling angle is large. Therefore, preferably, the controller determines a contribution level that the movement of the pivoting member accounts for in the movement of the entire work device in the land leveling work to have a larger value when the target land leveling angle is small than when the target land leveling angle is large, and calculates the target velocity by using the pivoting member gravity center velocity and the contribution level. This allows the work device to move properly such that the construction surface is leveled to the target land leveling angle in the land leveling work.

Preferably, the drive control device further includes a compacting pressure input device that receives input to adjust compacting pressure that is strength of force applied to ground by the pivoting member in the land leveling work, and the controller increases or decreases the contribution level based on the input to the compacting pressure input device. With this configuration, when the contribution level that the movement of the pivoting member accounts for increases, the compacting pressure increases, and when the contribution level that the movement of the pivoting member accounts for decreases, the compacting pressure decreases. Therefore, the controller can adjust the compacting pressure by increasing or decreasing the contribution level based on the input to the compacting pressure input device.

The pivoting member may include an arm pivotably supported by the boom, and a tip member pivotably supported by the arm, and the controller may calculate a composite center of gravity of the arm and the tip member as the center of gravity of the pivoting member. With this configuration, the controller calculates the movement of the arm and the movement of the tip member (for example, bucket) as the movement of the composite center of gravity, making it possible to inhibit the calculation process by the controller from becoming complicated.

Preferably, the drive control device further includes a setting input device that receives input for setting the target land leveling angle, and the controller sets the target land leveling angle based on an angle of the tip member when the input is made to the setting input device. With this configuration, in the land leveling work, the operator can cause the controller to set the target land leveling angle by simply placing the tip member at the desired angle on the construction surface and making input to the setting input device, allowing the operator to omit the work of inputting a numerical value of the target land leveling angle.

Preferably, the drive control device further includes a boom operation device to which a boom operation to move the boom is given, the controller calculates a boom correction value to move the boom to make the actual velocity of the composite center of gravity closer to the target velocity, and controls the movement of the boom by using a boom operation value according to an operation amount of the boom operation and the boom correction value. With this configuration, the boom correction value can be used to assist the boom operation the operator gives to the boom operation device.

In this case, the controller preferably uses the boom operation value and the boom correction value to calculate a control input value for controlling the movement of the boom to make a ratio of the boom correction value to the boom operation value higher when an operating skill of the operator regarding the land leveling work is low as compared with when the operating skill is high. With this configuration, when the operating skill of the operator is high, it is possible to perform the land leveling work according to the preference of a skilled worker with less assistance provided by the controller. Meanwhile, when the operating skill of the operator is low, by increasing the degree of assistance provided by the controller, even an unskilled worker can increase the work efficiency of the land leveling work.

A construction machine provided by the present disclosure includes the drive control device described above, the body, and the work device. This construction machine allows the work device to move such that the construction surface is leveled to the target land leveling angle in the land leveling work.

The invention claimed is:

1. A drive control device for a construction machine including: a body; and a work device including a boom supported by the body to allow a derricking movement and a pivoting member pivotably supported by the boom, the drive control device comprising a controller that controls a movement of the work device, wherein the controller:

sets a target land leveling angle that is a target for a land leveling angle in land leveling work performed by the work device;

calculates a pivoting member gravity center velocity that is a velocity of a center of gravity of the pivoting member;

calculates a target velocity that is a target for a velocity of a composite center of gravity of the entire work device by using the pivoting member gravity center velocity and the target land leveling angle; and controls a movement of the boom to make an actual velocity of the composite center of gravity closer to the target velocity, wherein the controller determines a contribution level that the movement of the pivoting member accounts for in the movement of the entire work device in the land leveling work to have a larger value when the target land leveling angle is small than when the target land leveling angle is large, and calculates the target velocity by using the pivoting member gravity center velocity and the contribution level.

2. The drive control device according to claim 1, further comprising a compacting pressure input device that receives input to adjust compacting pressure that is strength of force applied to ground by the pivoting member in the land leveling work, wherein the controller increases or decreases the contribution level based on the input to the compacting pressure input device.

3. The drive control device according to claim 1, wherein the pivoting member includes an arm pivotably supported by the boom, and a tip member pivotably supported by the arm, and the controller calculates a composite center of gravity of the arm and the tip member as the center of gravity of the pivoting member.

4. The drive control device according to claim 3, further comprising a setting input device that receives input for setting the target land leveling angle, wherein the controller sets the target land leveling angle based on an angle of the tip member when the input is made to the setting input device.

5. The drive control device according to claim 1, further comprising a boom operation device to which a boom operation to move the boom is given, wherein the controller calculates a boom correction value to move the boom to make the actual velocity of the composite center of gravity closer to the target velocity, and controls the movement of the boom by using a boom operation value according to an operation amount of the boom operation and the boom correction value.

6. The drive control device according to claim 5, wherein the controller uses the boom operation value and the boom correction value to calculate a control input value for controlling the movement of the boom to make a ratio of the boom correction value to the boom operation value higher when an operating skill of the operator regarding the land leveling work is low as compared with when the operating skill is high.

7. A drive control device for a construction machine including: a body; and a work device including a boom supported by the body to allow a derricking movement and a pivoting member pivotably supported by the boom, the drive control device comprising:

a controller that controls a movement of the work device, wherein the controller:

sets a target land leveling angle that is a target for a land leveling angle in land leveling work performed by the work device;

calculates a pivoting member gravity center velocity that is a velocity of a center of gravity of the pivoting member;

calculates a target velocity that is a target for a velocity of a composite center of gravity of the entire work device by using the pivoting member gravity center velocity and the target land leveling angle; and controls a movement of the boom to make an actual velocity of the composite center of gravity closer to the target velocity; and a boom operation device to which a boom operation to move the boom is given, wherein the controller calculates a boom correction value to move the boom to make the actual velocity of the composite center of gravity closer to the target velocity, and controls the movement of the boom by using a boom operation value according to an operation amount of the boom operation and the boom correction value, and wherein the controller uses the boom operation value and the boom correction value to calculate a control input value for controlling the movement of the boom to make a ratio of the boom correction value to the boom operation value higher when an operating skill of the operator regarding the land leveling work is low as compared with when the operating skill is high.

8. A construction machine comprising:

a body;

a work device including a boom supported by the body to allow a derricking movement and a pivoting member pivotably supported by the boom; and a drive control device comprising a controller that controls a movement of the work device, wherein the controller:

sets a target land leveling angle that is a target for a land leveling angle in land leveling work performed by the work device;

calculates a pivoting member gravity center velocity that is a velocity of a center of gravity of the pivoting member;

calculates a target velocity that is a target for a velocity of a composite center of gravity of the entire work device by using the pivoting member gravity center velocity and the target land leveling angle; and controls a movement of the boom to make an actual velocity of the composite center of gravity closer to the target velocity, and wherein the controller determines a contribution level that the movement of the pivoting member accounts for in the movement of the entire work device in the land leveling work to have a larger value when the target land leveling angle is small than when the target land leveling angle is large, and calculates the target velocity by using the pivoting member gravity center velocity and the contribution level.

* * * * *